United States Patent [19]

Gallagher

[11] 4,387,523

[45] Jun. 14, 1983

[54] WALLET HOLSTER FOR A SEMI AUTOMATIC WEAPON

[76] Inventor: Richard N. Gallagher, 918 Waukegan Rd., Glenview, Ill. 60025

[21] Appl. No.: 222,003

[22] Filed: Jan. 2, 1981

[51] Int. Cl.[3] ..... F41C 27/00

[52] U.S. Cl. ..... 42/1 J

[58] Field of Search ..... 42/1 J, 1 R, 1 N; 224/911

[56] References Cited

U.S. PATENT DOCUMENTS

| | | | |
|---|---|---|---|
| 309,292 | 12/1884 | Browne | 224/911 |
| 3,701,371 | 10/1972 | Stackhouse | 42/1 N |
| 3,707,250 | 12/1972 | Esposito | 42/1 R |
| 3,720,013 | 3/1973 | McDonald | 42/1 J |

*Primary Examiner*—Charles T. Jordan

[57] ABSTRACT

Disclosed is a wallet type holster for concealing a semi automatic weapon in a position to be accurately and precisely carried for use without removal from same. Moreover, the holster appears as a wallet even though a weapon is safely concealed therein for storage in a pocket of a user. The wallet holster includes operative features which permit the use of the weapon and assure the accurate positioning of the weapon within the holster.

10 Claims, 3 Drawing Figures

WALLET HOLSTER FOR A SEMI AUTOMATIC WEAPON

BACKGROUND OF THE DISCLOSURE

This invention relates to holsters for carrying weapons such as small hand guns to be used in protecting one's person. In particular, a holster in the form of a wallet or small purse adapted to surround and enclose the weapon but not interfer with the use or operation of same is disclosed.

It has been known to fashion weapon carrying holsters to protect the user by securely positioning the firearm in position for easy and convenient access while maintaining same in safe storage during normal physical movements. It has also been taught to provide a holster which will act to suitably conceal the weapon on the users person by surrounding the basic configuration of the weapon with a suitable semi-rigid material which changes the outer shape to that of something other than a gun. The McDonald U.S. Pat. No. 3,720,013 shows a concealing pouch for carrying a handgun. The McDonald pouch includes a slit for use in reaching the trigger and gas vents to release explosive gases. There is no disclosure of a means through which the bullet may leave the McDonald pouch and therefore use of same necessitates replacement of the pouch since a hole is blown through the barrel end of same by the bullet. Zipper openings also are provided to somewhat facilitate loading of the gun.

Another prior patent to Esposito U.S. Pat. No. 3,707,250 discloses a gun holster in the form of a glass carrying case and is designed to be carried in a pocket near the chest of the user. Here the weapon may be fired without removal from the holster but the weapon is not completely concealed or completely contained in the user's pocket. Consequently, the Esposito holster is nothing more than a support for the clip which secures the holster to the outside of the pocket in a manner similar to the way an eyeglass case is carried in a vest pocket.

Small and compact weapons have been known for sometime and in particular the Derringer is the most famous of the pocket pistols. It has also been known to provide a wallet holster to support and carry a Derringer pistol. Such holsters have been fashioned from a flat sheet of leather at which a marginal end includes a folded over flap of material preformed to receive the barrel of the pistol. The material of such a leather holster is sufficiently large so that it can wrap around the back of a small weapon extending along both sides to completely enclose same and provide a concealed wallet shaped jacket to contain the gun. In each side of the jacket is provided on opening which cooperates with the trigger of the weapon such that it may be fired while held between the sides of the wallet holster. In the user's pocket the holster is positioned with the open or muzzle end downwardly disposed such that the spine of the leather wrap around faces upwardly and outwardly to appear like a billfold. This aids in the concealment and protects the user. For example, if accosted by an armed robber the victim would reach for the wallet and come up with a protective weapon instead.

Many problems were presented in connection with the use of such a holster for the Derringer pocket pistol. In particular the gun was held in position in the holster merely by the barrel pocket. Consequently, the exact angle and location of the gun was not certain since the location of the gun was a function of its initial placement in the holster, jostling which took place after placement or the looseness caused by wear and tear on the barrel pocket. Another difficulty with such an arrangement was that the weapon had to be removed for reloading and with the limited capacity of a two shot firearm reloading could be frequent and onerous.

It became essential to provide a wallet holster like that used for the Derringer pocket pistol which would conceal a small, compact and easy to use semi automatic weapon, but would allow the weapon to be loaded and reloaded without removal from the holster. It was also deemed necessary to have a wallet holster which would permit the action occurring during use of such automatic firearms. The disclosure of the invention which follows will include a wallet holster capable of use with a small automatic type weapon.

OBJECTS OF THE DISCLOSURE

It is an object of this invention to provide a wallet shaped holster for an automatic type weapon which permits same to be carried and used without removal from the wallet.

It is a further object of the present disclosure to teach the construction of a wallet holster which permits an automatic weapon to be accurately supported within the holster and yet facilitates loading and reloading.

It is still a further object of the invention to provide a wallet holster which permits the cocking and slide manipulation of the gun to take place as required with automatic type weapons without need of removing same or opening the wallet to have access for same.

It is yet another object of the present disclosure to explain how an inexpensive, reliable and convenient wallet type concealing holster can be fashioned for a small semi automatic handgun.

SUMMARY OF THE DISCLOSURE

For sometime a small automatic gun such as the Beretta Jet Fire or Minx series 950 have been available for 25 or 22 caliber ammunition, respectively. These weapons are compact and shaped with generally square and planar sides such that they would fit within the confines of a wrap around open fronted wallet type concealing holster. The Beretta pistol has strength, precision, sturdiness and safety devices usually characteristic of pistols having larger caliber, weight and dimensions. Loading of the Beretta automatic pistol requires little physical strength due to the barrel mounting system.

The fully loaded magazine may be pressed upwardly into the magazine well of the grip until a locking click indicates catch engagement. The holster is open downwardly to facilitate magazine loading of the gun being held within the holster even though the sides of the gun handle grip are fully enclosed and so concealed by the surrounding leather portions of the holster sides and spine. Even the ledge support for the grip does not interfer with the loading. Once the magazine had been loaded into the grip, the slide serrations of the pistol may be grasped by slipping the thumb and index finger in the space between the insides of the holster sides and the gun. The holster sides are flexible enough yet resilient whereby they permit use of the gun without interference. The slide may be retracted to a full and solid stop thus activating the recoil spring and cocking the hammer. Quick release of the slide will permit same to automatically advance or close driving the first cartridge from the top of the magazine into the chamber.

Another method of loading the barrel without manual slide manipulation to a full magazine capacity plus one extra bullet in the chamber may be accomplished by tilting the barrel about its transversely disposed pivot. A release for the barrel is conveniently disposed upon the upper left side of the gun above the trigger where it can be reached by bending the side away so the release may be used to unlatch the barrel without removing the gun from the holster. A simple movement of a barrel release lever allows the barrel to swing or tilt upwardly, about a transverse pivot located across the gun at the muzzle end, exposing the chamber for direct loading. An additional cartridge may then be inserted into the chamber and the barrel can then be swung downwardly about its pivot until a sharp latching click is heard indicating that the barrel release has engaged. The open top of the holster permits complete and easy access for such maneuvers, and the barrel support loop is far enough forward to allow the barrel tilt without interference. After closing the barrel and insertation of a loaded magazine through the base of the handle grip the gun is ready to use with the maximum compliment of ammunition.

After loading, the pistol is ready for use. Since this is a semi automatic weapon, the pistol cannot be fired unless the hammer is fully cocked and the safety is in its downward turned position. The safety lever is conveniently located at the rear left side of the pistol such that it can be reached by bending away the top rear side portions of the holster. Consequently, the pistol may be quickly and easily loaded and then set to fire without need to remove same from the holster. Once the pistol is fired the force thereof drives the slide rearwardly to eject the spent cartridge upwardly and outwardly while at the same time moving the slide back to catch the next topmost bullet in the magazine. As the slide begins its return under the urging of spring loading a fresh bullet is carried into the chamber whereby the process can be repeated. A relief is cut into the top of the spine located at the back of the holster and it is the spine relief which permits the slide to move without resistance from the holster.

Thus the holster with its unique wrap around configuration permits the action of the semi automatic weapon to take place unhampered because the top and bottom of the holster are completely free of obstructions. In addition, there are three features including a top relief in the spine which cooperates to permit hammer and slide movement, an inside retaining ledge to position the bottom of the pistol grip but not interfer with magazine loading and a front barrel loop to hold the barrel but not restrain the upward tilting thereof for chamber loading. It is the aforesaid construction which permits a wallet holster capable of use for carrying a compact automatic weapon such as a Beretta.

DETAILED DESCRIPTION OF THE DISCLOSURE

Figure 1:
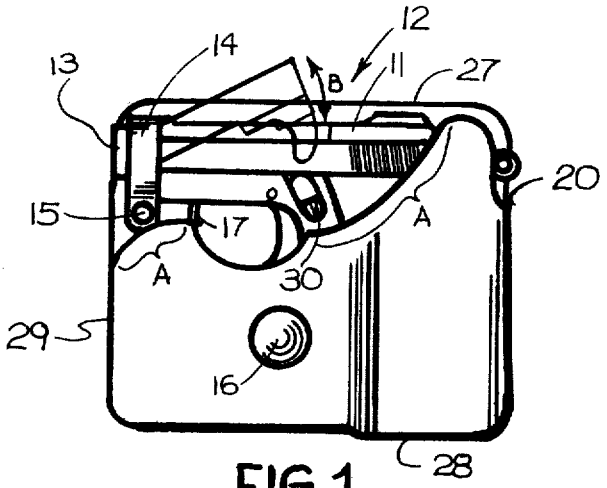
FIG. 1 is a side elevational view of the holster and gun with portions thereof cut away to illustrate the manner in which the weapon is positioned within the closed holster and the tipped position of the barrel is shown in phantom.

FIG. 1 shows the Beretta semi automatic pistol carried inside the wallet holster of the present invention. The holster being cut away at "A" to reveal the placement of the weapon 11 in the holster 12. As can be seen from the figure the barrel end 13 of the weapon 11 is carried by a loop 14 of leather material which wraps transversely around the barrel end 13 and is attached to the holster by rivet 15 at the end which shows and by means to be explained at the other end. The holster 12 includes a snap 16 provided in a position just beneath the trigger frame 17 of the weapon 11 whereby the holster 12 can be maintained in position wrapped about the weapon 11.

Figure 2:
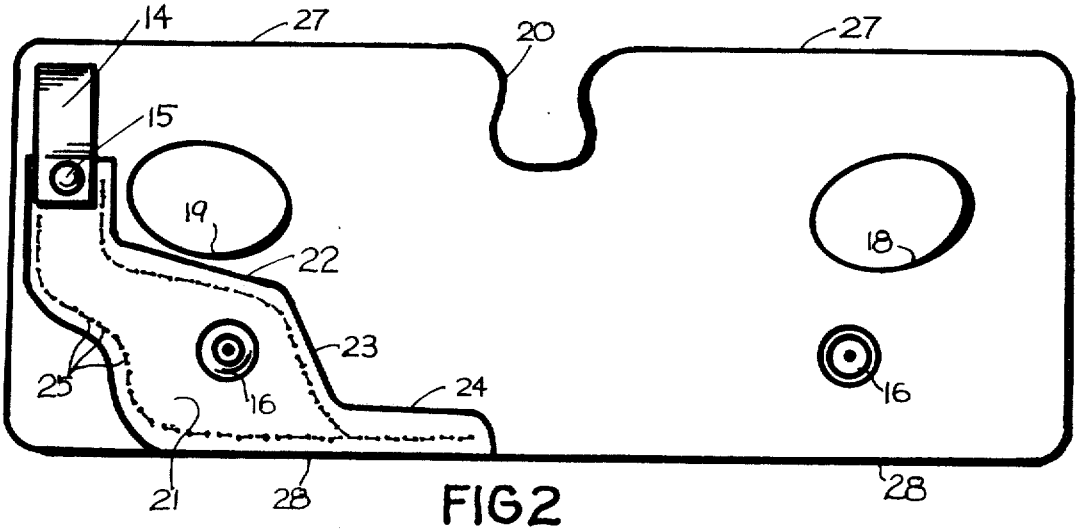
FIG. 2 is a side elevational view of the holster and the wallet holster being snapped open to show where the gun rests on a support member within the holster.

As best depicted in FIG. 2 the holster 12 is constructed of a flat rectangular sheet of leather material which is precut to include front and rear trigger openings 18 and 19, respectively. Openings 18 and 19 are shaped to generally match the trigger frame 17 of the weapon 11 when the holster 12 is wrapped about the weapon 11. Holster 12 is as explained formed from a flat sheet of leather and is generally rectangular in configuration being longer on the top and bottom dimensions. At the center of the top there is provided a relief opening 20 which is generally U-shaped and its purpose will be discussed in detail in the explanation of the operation of the weapon 11 and the holster 12 as a combination.

As shown in FIG. 2 there is a supporting member 21 fashioned from an additional piece of flat leather stock and cut specifically to conform to the shape of the weapon 11 (in the preferred embodiment illustrated as a Beretta model 950). Supporting member 21 includes a downwardly angled upper ledge 22 fashioned to cooperatively support the trigger frame 17 along its lower edge (not shown). Extending downwardly and rearwardly from ledge 22 is a front grip support abutment portion 23 of the support member 21. The angle of rearward inclination is such that the front of the grip of weapon 11 bears against abutment 23 when the weapon 11 is contained within the holster 12 as shown in FIG. 1. There is a final portion of supporting member 21 which bears explanation in connection with the support of weapon 11 within the closed holster 12 and that portion is a horizontally disposed shelf 24 which extends rearwardly from the base of abutment 23 to support the bottom of the grip of weapon 11. The holster 12 when wrapped about the weapon 11 and snapped together at snap 16 will conform support member 21 to the shape of the weapon. That is to say that, the area of support member 21 near trigger frame 17 will wrap inwardly toward the center plane of the weapon to support it. The thickness of supporting member 21 is such that the opening designed to receive the magazine for ammunition into the base of the grip is not obstructed.

Supporting member 21 is held fast to the main body portion of the holster 12 by means of peripheral stitching 25 and the male portion of snap 16. Supporting member 21 is also used as a spacer beneath the rivet 15 which holds an end of loop 14. The opposite end of loop 14 is riveted to the main body of holster 12 just above the upper part of supporting member 21 whereby the opening in the loop is positioned slightly outwardly from the body wall of holster 12. The rivet which carries the opposite end of loop 14 is not apparent in the figures but operates in a manner understood by those skilled in the art of leatherworking to join the loop end and the holster body. As can be appreciated the female portion of snap 16 is disposed at the opposite side of the holster 12 such that folding the holster in half transversely to its longitudinal or elongated dimension will provide a wrap around configuration relative to the weapon 11.

Figure 3:
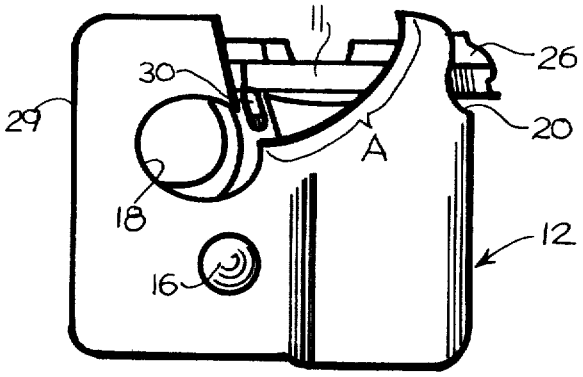
FIG. 3 is a side elevational view of the closed holster wrapped about the weapon and showing how the action of the slide during firing is permitted by the holster relief.

FIG. 3 is quite similar to FIG. 1 in that a portion of holster 12 has been cut away at "A" to disclose the cooperation between the weapon 11 and the holster 12. In FIG. 3 the weapon 11 is shown in a stop action position. That is to say that, the slide 26 which is the rear top part of the weapon 11 is in its full rearward position on weapon 11. There is no interference with the holster 12 since adequate clearance for rearward slide motion is provided by the relief opening 20. The Beretta semi automtic weapon is as explained capable of being chamber loaded. This is accomplished by tipping the front portion of the barrel upwardly about a transverse barrel end pivot in an arcuate motion as indicated by arrow "B" in FIG. 1. The tipped barrel position is shown by phantom like lines in FIG. 1. The barrel tipping is permitted by the inherent flexibility of the leather loop 14 which holds the barrel end 13 of the weapon 11 steady and accurately positioned within the holster 12 and yet allows the necessary pivotal motion for easy chamber loading.

As can be appreciated from the preceeding explanation, the wallet holster is formed by wrapping an elongated flat rectangular piece of leather about the weapon 11. This provides a generally open configuration along the top and bottom portions 27 and 28 respectively of holster 12. Similarly the front 29 of holster 12 is also opened near the top in the area forwardly of the loop 14 thereby exposing the barrel end 13 of the weapon 11. Should it be necessary to reach along the sides of the weapon 11 to adjust or control same it is easy to slide ones fingers in the space between the inside upper surfaces of the holster 12 and the weapon 11 near the slide 26 by merely bending the holster outwardly relative to weapon 11. More particularly there is a barrel release latch 30 (see FIGS. 1 and 3) which must be pressed to pivot it forwardly and downwardly to release the barrel so it can tip as shown in FIG. 1 for chamber loading. Also located on the same side of the weapon 11 as the barrel release 30 but disposed at the rear upper corner of the grip is a safety lock lever (not shown). That lock lever may be reached by placing a finger just forwardly of the inside upper rearward edge of relief 20. Similarly for loading there is a button (also not shown) which must be depressed to release the magazine. The button is located along the side of the grip on weapon 11; it can be reached and activated by pressure brought to bear upon the side of the holster 12 in the area next adjacent to the button.

In operation the weapon 11 is carried within the holster 12 to form a compact assembly which appears and feels like a wallet. The combination can be placed in a rear pants pocket or a breast coat pocket as would a wallet. The user is thus able to draw the weapon and holster combination out of the pocket and at the same time dispose the trigger finger through the trigger openings 18 and 19 in order to prepare for use of the weapon to protect against injury during a robbery or battery. The appearance of the combination is such that the criminal will be totally unaware of its potential until it is completely removed from the pocket and aimed in position to defend the user. If more than a pair of shots are required or the ability to fire in rapid succession is necessary, the present holster 12 when used in combination with a semi automatic weapon 11 will provide the user with the capability of firing multiple shots without reloading.

The overall configuration of the holster 12 of the present invention is particularly adapted to be used in combination with a Beretta type semi automatic weapon. It will be appreciated by those skilled in the art of holster design and leather working that modifications and changes in particular cooperating openings and supporting members could be made without departing from the overall concept of a holster in the shape of a wallet which is specifically and uniquely adapted to precisely positioning and retaining a weapon whose component portions must during use articulate independently of the confines of the holster and whose control mechanism must be readily reachable in order to permit easy and proper operation of same.

Therefore, the true and proper spirit of the claims which follow should cover any wallet type holster for accurately positioning a weapon which operates to produce multiple fire capacity without hindrance from the holster.

I claim:

1. A wallet holster including, (a) a flat elongated rectangular semi flexible body designed to fold amid its longer dimensions for wrapping forwardly about the sides of a weapon and creating inside and outside surfaces, (b) a loop of semi flexible material connected to said body at the end most distal from said fold on an inside surface thereof and arranged to carry the barrel end of the weapon parallel to one of the longer dimensions of said body, (c) openings provided in said forwardly wrapping sides of said holster for permitting control of the weapon trigger without removing the weapon from said holster, (d) supporting means being semi flexible and carried along an inside surface of said body adjacent said loop and extending toward said fold to cooperatively engage the forwardly lower portions of the weapon, (e) releasable engagement means juxtaposed on said inside surfaces to hold same together and tightly against the forwardly lower portions of the weapon, and (f) relief means provided along the folding portion of said body to allow motion of the weapon relative thereto and to permit said longer dimensions of said body to be bent away from the top of the weapon.

2. The wallet holster of claim 1 wherein said supporting means includes a strip of semi flexible material shaped to follow the lower forwardly contour of the weapon with an edge of said material when said releasable engagement means is juxtaposed.

3. The wallet holster of claim 2 wherein said releasable engagement means are inter cooperating fasteners each carried on opposite portions of said flat elongated body for juxtaposed connection when said body is wrapped about the sides of the weapon.

4. The wallet holster of claim 1 wherein said relief means is a cutout portion of said body designed to permit weapon movement therethrough and to allow the upper marginal side portions of said body to flex outwardly relative to the sides of the weapon.

5. The wallet holster of claim 4 wherein said releasable engagement means are inter cooperating fasteners each carried on opposite portions of said flat elongated body for juxtaposed connection when said body is wrapped about the sides of the weapon.

6. A web of resilient material designed to conceal a weapon having a barrel and handle and carry same in position for operative use including, an elongated generally rectangular web being pliable and having a first loading position arranged to receive the weapon and being an open flat with a surface equipped to hold and locate the weapon and a second weapon concealed position with said web wrapped forwardly about the weapon handle over said holding and locating surface and being folded substantially in half about the weapon handle located against said fold.

7. The web of claim 6 wherein openings for control and operation of the weapon are provided in said web to permit use of the weapon without removal of same from said second position.

8. The web of claim 6 wherein said fold includes an opening to permit the operation and use of the weapon without removal of same from said second position.

9. The web of claim 6 wherein said surface equipped to hold and locate has a first means to support the weapon barrel in said first and second positions and a second means to support the weapon handle when said web is in said second position.

10. The web of claim 9 wherein fastening means being provided to hold said web in said second position.

* * * * *